US005751117A

United States Patent [19]

Abbott

[11] Patent Number: 5,751,117

[45] Date of Patent: May 12, 1998

[54] MODULAR FLUORESCENT TRACK LIGHTING

[75] Inventor: Louis Eugene Abbott, Carson City, Nev.

[73] Assignee: Bruce Industries, Inc., Dayton, Nev.

[21] Appl. No.: 371,847

[22] Filed: Jan. 12, 1995

[51] Int. Cl.[6] ..... H05B 41/00

[52] U.S. Cl. ..... 315/244; 315/105; 315/283; 362/249; 362/250; 362/270; 362/260; 362/285; 439/226; 439/235

[58] Field of Search ..... 362/249, 250, 362/270, 285, 260, 404, 405; 439/115, 235, 226, 698; 315/244, 105, 94, 177, 283

[56] References Cited

U.S. PATENT DOCUMENTS

| | | | |
|---|---|---|---|
| 2,333,499 | 11/1943 | Warren | 315/105 |
| 2,721,296 | 10/1955 | Asano et al. | 315/247 |
| 3,307,072 | 2/1967 | Kurt et al. | 315/177 |
| 4,092,562 | 5/1978 | Campbell | 315/189 |
| 4,748,548 | 5/1988 | Barton | 362/249 |
| 5,253,152 | 10/1993 | Yang et al. | 362/221 |
| 5,368,495 | 11/1994 | Raby, Sr. et al. | 439/226 |
| 5,389,857 | 2/1995 | Abbott et al. | 315/94 |

*Primary Examiner*—Robert Pascal
*Assistant Examiner*—Arnold Kinkead
*Attorney, Agent, or Firm*—Beehler & Pavitt

[57] ABSTRACT

A modular ballast system particularly suited for strip lighting installations has ballast modules on opposite ends of each fluorescent lamp tube, each module having lamp connectors for receiving the end pins of the fluorescent lamp, capacitance and inductance elements connected to the lamp connectors in each module, and jumper conductors interconnecting the capacitance and inductance elements of the modules to define a bridge type ballast circuit for powering the fluorescent lamp. Each ballast module can be made small and lightweight with a single inductor and capacitor forming two legs of a four leg bridge type ballast. Pairs of ballast modules can be connected back-to-back to transmit electrical power without external wiring to successive fluorescent lamps along the strip.

16 Claims, 3 Drawing Sheets

MODULAR FLUORESCENT TRACK LIGHTING

BACKGROUND OF THE INVENTION

1. Field of the Invention

This invention relates to the field of artificial lighting and more particularly is directed to a modular system for fluorescent strip lighting installations.

2. State of the Prior Art

Fluorescent interior lighting is in widespread use due to the relatively high efficiency of fluorescent lamps and an emission light spectrum which more closely approximates daylight as compared to incandescent lighting. A characteristic of fluorescent lighting is that light is emitted continuously along the length of the fluorescent lamp tube. The lamp tubes are commercially available in various lengths, most commonly in 24, 36 or 48 inch lengths, although 6 and 8 foot lamp tubes are also available. This characteristic enables fluorescent lamps to be installed end-to-end in continuous strips along ceilings or walls, sometimes running the full length of an interior space, to provide well distributed and relatively shadowless illumination.

Fluorescent lamp tubes of the type commonly used for interior lighting have a heater filament connected between two contact pins at each end of the tube. Each tube in a strip lighting installation is held between two lamp holders which provide mechanical support for the tube and also make electrical contact with the end pins of the lamp tube. Electrical power, both the low voltage filament current and line voltage for the lamp arc current, are normally provided by a ballast circuit to the lamp pins via the lamp holders. The ballast is a separate, self-contained unit mounted near the lamp tube and connected by wire conductors to each of the two lamp holders at opposite ends of the tube. A ballast unit may power one or more lamp tubes, but in every case at least two wires must be connected from the ballast to each lamp holder. The result is that conventional fluorescent strip lighting installations require considerable wiring, which makes such installations labor intensive and complicates their maintenance. What is needed is a more flexible strip lighting system which dispenses with the need for extensive wiring between the lamp holders and ballast units for easier and more economical installation and maintenance, as well as greater reliability.

SUMMARY OF THE INVENTION

The aforementioned need is addressed by this invention which provides a modular fluorescent track lighting system in which the current ballasts have been integrated with the lamp holders thereby eliminating the need for both separate mounting of the ballasts and the wiring between the ballasts and the lamp holders. The modular track lighting system of this invention makes use of a ballast bridge circuit which is the subject of this applicant's co-pending patent application Ser. No. 08/065,538 now U.S. Pat. No. 5,389,857. The ballast circuit is configured as an inductance-capacitance bridge. The construction and operation of the ballast bridge circuit is described in the aforementioned patent application Ser. No. 08/065,538, which is incorporated in its entirety as part of this disclosure. The ballast bridge circuit is symmetrical, consisting of two inductances and two capacitances connected as four arms of a bridge circuit. In the modular system of this invention, the ballast bridge circuit is physically separated into two separate modules, each module containing an inductance and a capacitance constituting two arms of the bridge. A single pair of conductors connects the two modules at opposite ends of each lamp tube, to complete the ballast circuit. No additional wiring is needed other than a connection to the A.C. power main. Each ballast module is compact and relatively lightweight, with a module housing adapted for snap mounting onto a track which is fastened to a supporting surface, such as a wall or ceiling. Different lamp tube lengths can be easily accommodated along the track by simply providing the required spacing between pairs of ballast modules. A lighting strip of any desired length can be assembled on a continuous track by mounting pairs of ballast modules for each lamp tube. Lamp tubes of different length can be mixed to make up a strip of particular overall length and light output.

Each ballast module is preferably provided with a pair of back connectors for electrically coupling pairs of ballast modules mounted back-to-back on the track, to establish an A.C. power connection between physically adjacent ballast modules, thereby further dispensing with external wiring along the track. When so connected, a continuous A.C. power rail is established along the length of the track which can be fed by a single connection to the A.C. power main at any point along the lighting strip.

More specifically, the ballast system according to this invention includes first and second ballast modules supported on a base in spaced relationship to each other for holding between them a fluorescent lamp tube. Each ballast module has a module housing, a pair of lamp connectors on the housing for making electrical contact with opposite ends of a heater filament at one end of a fluorescent lamp tube, first and second A.C. power connectors, an inductance connected between one of the lamp connectors and one of the A.C. power connectors, and a capacitance connected between the other of the lamp connectors and the other of the A.C. power connectors. Electrical conductors between the two ballast modules connect each A.C. power connector on one module to a corresponding A.C. power connector on the other module.

The lamp connectors ón the module housing may be on a front side of the housing, and the A.C. power connectors may include a front connector pair on the front side and a back connector pair on an opposite, rear side of the housing. The front and back A.C. connector pairs are electrically connected to each internally to the module housing and provide for A.C. power throughput from one side to the other of the ballast module. The back connectors of each module are configured to mate with the back connectors of another module when the modules are coupled in back-to-back relationship, so as to supply A.C. power from one to another of the coupled modules.

The preferred base is an elongated track and the module housing may have snap mounting elements for releasably interlocking the module housing with the track at any of multiple mounting locations along the track.

DETAILED DESCRIPTION OF THE PREFERRED EMBODIMENTS

Figure 1:
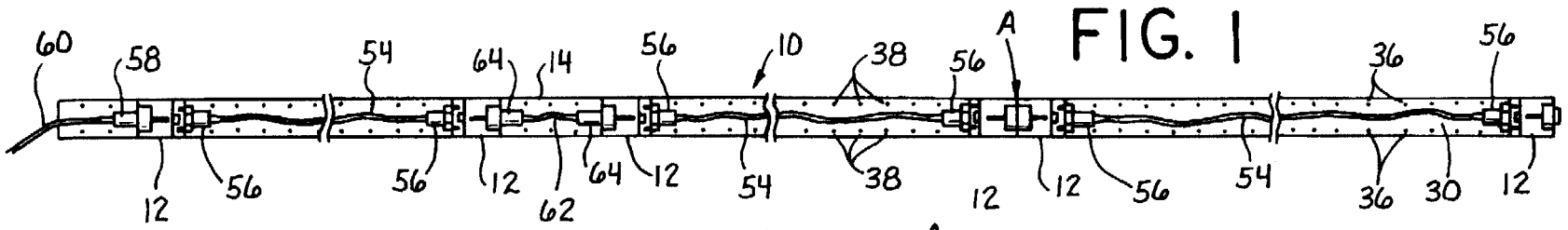
FIG. 1 is a top plan view of a track lighting installation with three pairs of ballast modules mounted to a length of track, depicted without fluorescent lamps for clarity of illustration.
Figure 2:
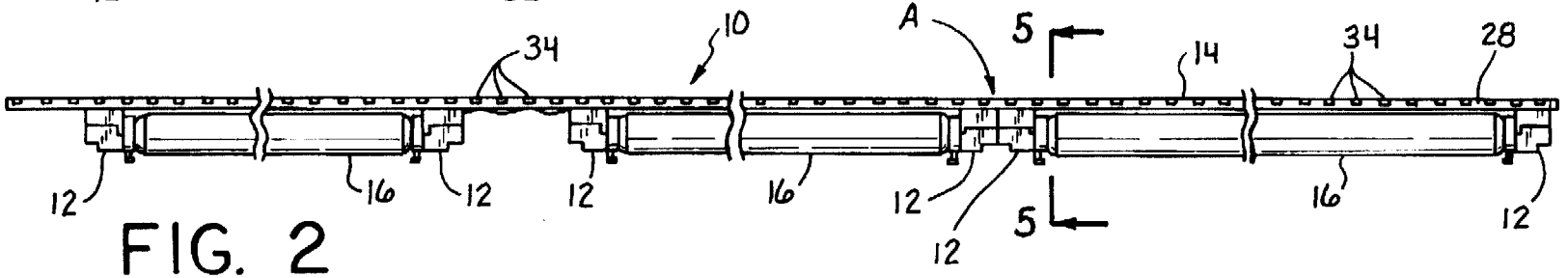
FIG. 2 is a side view of the track lighting installation of FIG. 1 with fluorescent lamp tubes installed between ballast module pairs.

With reference to the accompanying drawings, wherein like numerals designate like elements, FIGS. 1 and 2 show a track lighting system generally designated by numeral 10 in which three pairs of ballast modules 12 are mounted along a track 14. The ballast modules 12, if constructed according to the teachings of the earlier referenced disclosure, can be essentially identical and interchangeable with each other, and are grouped in pairs mounted in mutually facing relationship for supporting between each pair a fluorescent lamp tube 16, as shown in FIG. 2.

Figure 4:
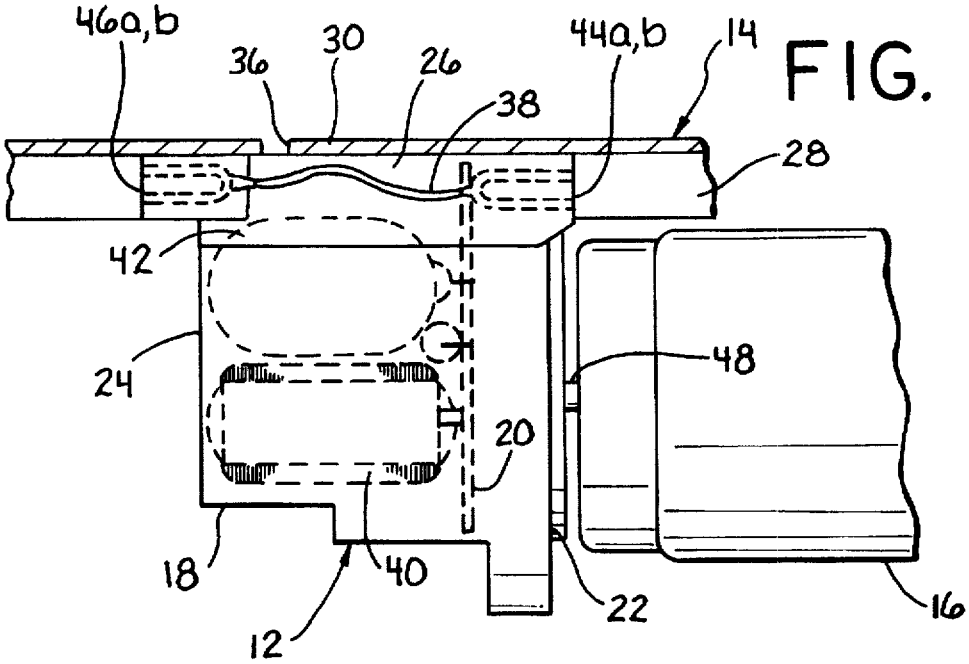
FIG. 4 is a side elevational view of a ballast module mounted to the track and supporting one end of a fluorescent lamp tube, also showing in phantom lining the electrical components mounted on an internal circuit board of the module.
Figure 5:
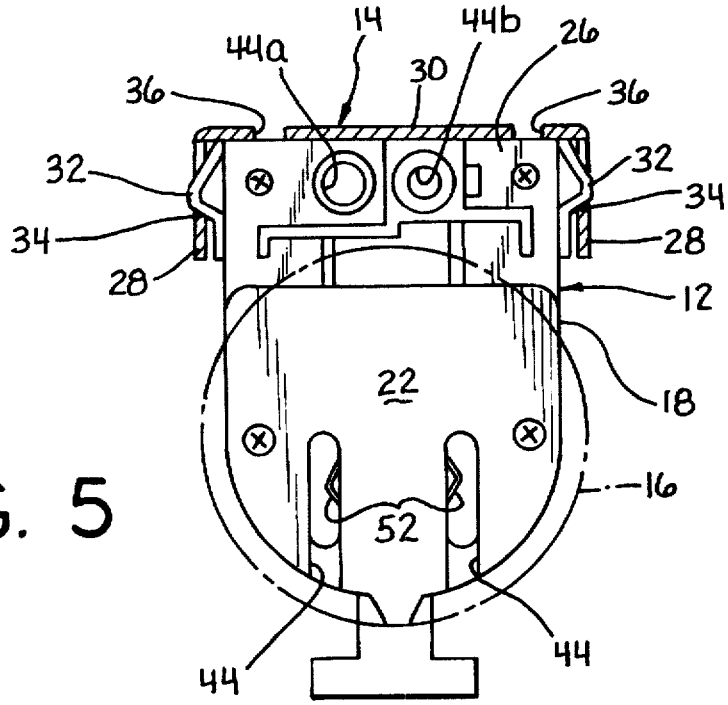
FIG. 5 is a front view of a ballast module seen along line 5—5 in FIG. 2, showing the lamp connectors and the front pair of A.C. connectors of the module as well as the snap retainers for mounting the module to the track.

As better seen in FIGS. 4 and 5, a ballast module 12 has a module housing 18 with a front side 22, a back side 24 and a module bottom 26. The module bottom 26 is contained between the side walls 28 and the bottom 30 of the track 14 by means of resilient detent elements 32 which make a snap engagement within side openings 34 in the track sides 28. As seen in FIGS. 1 and 2, side openings 34 are spaced at regular intervals along the length of the track 14. A ballast module 12 can be mounted to the track 14 at any of the side openings 34 along the track. The spacing between modules 12 in each module pair can be selected so as to accommodate different lengths of fluorescent lamp tubes 16, as shown in FIG. 2. Mounting of a ballast module 12 is done by simply pressing the bottom 26 of the module into the track 14 with the snap retainers 32 in proper alignment with the corresponding openings 34 in the track. Removal of a module is accomplished by pressing inwardly the detents 32 on either side of the track, and pulling the module 12 out of the track.

Each ballast module 12 houses a circuit board 20 which carries a toroidal inductor 40 and a capacitor 42. The front side 22 of the module housing defines a pair of pin receiving slots 52 which accept two lamp pins 48 such as are found at each end of a conventional fluorescent lamp tube 16. A heater filament 50 internal to the lamp tube is connected between the two pins at each end of the lamp tube as best seen in the circuit diagram of FIG. 3*a*. The slots 44 guide the lamp pins 48 into electrical contact with a pair of lamp connectors 52 supported by the module housing. The lamp pins 48 slide into slots 44 and are retained against the closed bottom of the slots by the spring action of connectors 52. Each ballast module 12 also has a front pair of A.C. connectors, including a female connector **44*a* and a male connector 44*b*, near the bottom 26 of the module, so that the connectors lie within the track 14 between the track sides 28, as shown in FIG. 5. A second pair of A.C. back connectors 46*a* and 46*b* are provided on the rear side 24 of the module housing. The two connector pairs 44*a,b* and 46*a,b* are in axial alignment with each other in the direction of the track 14. Front connectors 44*a,b* are mounted on the circuit board 20. The rear connectors 46*a,b* are each electrically connected to the circuit board by a corresponding jumper wire 38. The male connector 44*b* is electrically connected to female connector 46*a*, while female connector 44*a* is electrically connected to the male connector 46*b*. The front and rear connector pairs in effect form an A.C. power bus to feed-through A.C. power bi-directionally between the opposite sides 22, 24 of the ballast module 12. The male connector 44*b* is axially aligned with the female connector 46*a* and the female connector 44*a* is axially aligned with the male connector 46*b*. The back connectors 46*a,b* of two ballast modules 12** can be directly mated to each other to electrically couple the two modules in back-to-back relationship as indicated at A in FIGS. 1, 2, and 3.

Figure 3:
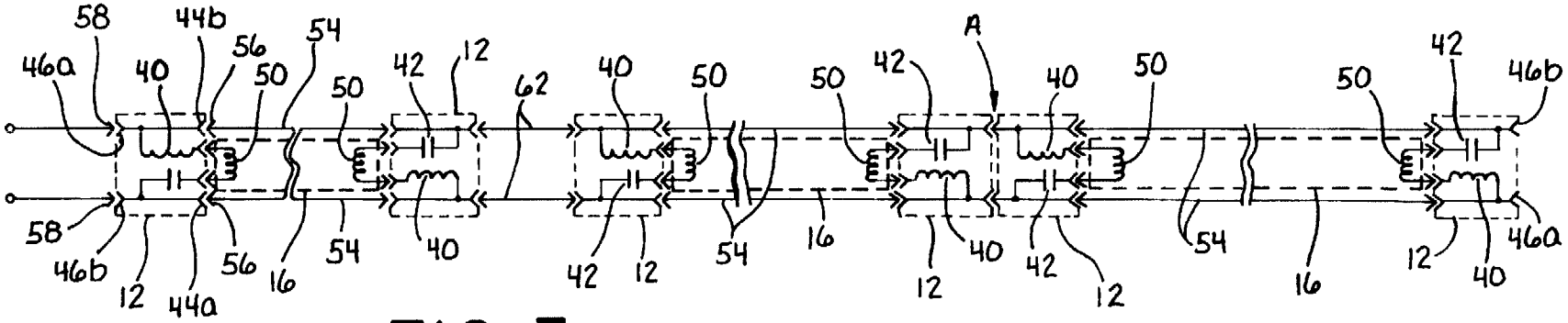
FIG. 3 is an electrical circuit diagram of the strip lighting installation of FIGS. 1 and 2.

FIG. 3 is a circuit diagram representing the lighting strip of FIGS. 1 and 2. Each ballast module 12 is represented by a square box in dotted lining. The fluorescent lamps 16 are represented as elongated rectangles, also in dotted lining. The heater filament 50 at each end of the lamp tube 16 is connected between the lamp contacts 48. As better seen in FIG. 3*a* the inductance 40 is connected between one lamp connector 52 and one side of the A.C. supply to the module, i.e., one of the A.C. connectors **44*a*, 44*b*. The capacitance 42 is connected between the other lamp connector 52** and the other side of the A.C. supply.

Figure 3A:
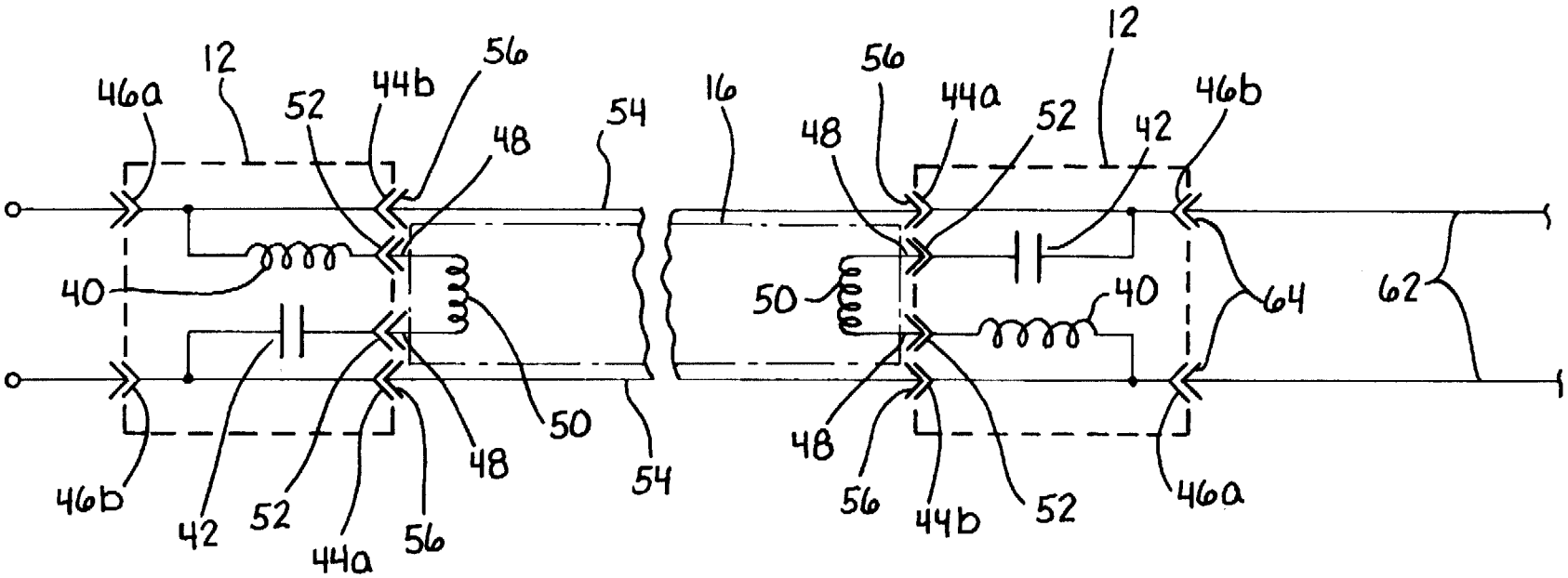
FIG. 3*a* is an enlarged portion of the circuit diagram of FIG. 3.

As shown in FIGS. 3 and 3*a*, when paired in face-to-face relationship at opposite ends of a lamp 16, the modules 12 inherently position the inductance 40 and capacitance 42 on opposite arms of the ballast bridge circuit. The bridge circuit is completed by a two conductor harness 54 which has two-prong connectors 56 at each end. Connectors 56 plug into the front pair of A.C. connectors **44*a*, 44*b* of each ballast module 12 of the module pair. The harness 54 including its connectors 56 is contained within the track 14, and is largely hidden by the lamp tubes 16, as seen in FIG. 2. A.C. power is provided to the track lighting installation 10 by a single two-conductor cable 60 and two-prong connector 58 which plugs into the back connectors 46*a*, 46*b* of the end ballast module 12** on the left hand side of the track in FIGS. 1–3.

A.C. power is transmitted from one ballast bridge circuit to another along the track 14 either through a direct back-to-back connection between physically coupled modules 12, as previously explained with reference to character A in FIGS. 1–3, or by means of a two-wire harness 62 which terminates at opposite ends in two-prong connectors 64. Each connector 64 plugs into the back connectors **46*a*, 46*b* of the spaced apart back-to-back ballast modules 12 being connected. In cases where the track lighting strip includes many lamps 16, it may be desirable to feed A.C. power to the system at more than a single point in order to better distribute the electrical load. Additional A.C. feeds can be connected anywhere along the track system, such as at any harness 62 which spans a gap between two ballast modules 12. As best appreciated in FIG. 3, the A.C. feed-through connections in each ballast module between the front and rear pairs of A.C. connectors, together with the harnesses 54 and 62**, all cooperate to form a continuous A.C. power rail extending the full length of the track lighting system, so that A.C. power can be connected to the rail at any point or multiple points along its length.

From the foregoing it will be appreciated that the modular track lighting system can be readily adapted and configured to the requirements of any particular installation in terms of the total number of lamps to be accommodated, the total length of the lighting strip, and the length of the individual lamps. The track lighting system of this invention also easily accommodates any separation that may be needed between consecutive lamp tubes along the track, for example, due to the presence of interfering structural elements in the vicinity of the track 14 or because of light distribution considerations. The modular system 10 is made of few parts, and all ballast modules 12, if constructed according to the teachings of the already referenced co-pending patent application Ser. No. 08/065,538 can be identical and interchangeable with each other for a wide range of wattages of the individual fluorescent lamps 16.

Installation and assembly of the system is quick and easy. The track 14, which can be made up of individual segments of any convenient length, is affixed to a suitable mounting surface by means of screw fasteners inserted through screw holes 36 spaced along the track. The ballast modules 12 are then snapped onto the track 14 at locations and intervals dictated by the desired location and lengths of the fluorescent lamp tubes. The ballast modules 12 are then interconnected by means of the harnesses 54, and, if needed, additional harnesses 62 if gaps exist between back-to-back modules. Finally, fluorescent lamp tubes 16 are installed between mutually facing pairs of ballast modules 12. A.C. power is supplied by one or more plug-in connectors 58 to complete the installation. Because of its modular, plug-together nature, the track lighting system 10 of this invention is easily serviced when needed, and equally easily modified should lighting requirements change at any time after initial installation. Lamps and ballast modules can be easily removed, or larger lamps replaced by smaller ones with equal ease.

While particular embodiments of the invention have been described and illustrated for purposes of clarity and example, it must be understood that many changes, modifications and substitutions to the described embodiments can be made by persons possessing ordinary skill in the art without thereby departing from the scope and spirit of the present invention as defined in the following claims.

What is claimed is:

1. A modular ballast system for a fluorescent lamp of the type having a heater filament at each of two opposite lamp ends, said ballast system comprising:

first and second ballast modules, each of said ballast modules having a module housing, a pair of lamp connectors on said module housing adapted to make electrical contact with opposite ends of a said heater filament, first and second A.C. power connectors on each of said ballast modules, an inductance between one of said pair of lamp connectors and one of said first and second A.C. power connectors, and a capacitance between the other of said pair of lamp connectors and the other of said first and second A.C. power connectors;

electrically conductive means for connecting said each of said first and second A.C. power connectors on one of said ballast modules to a corresponding one of said first and second A.C. power connectors on the other of said ballast modules thereby to complete a four arm bridge types ballast; and a base for supporting both said ballast modules in spaced relationship to each other for holding a fluorescent lamp therebetween.

2. The modular ballast system of claim 1 wherein said pair of lamp connectors are on a front side of said module housing and further comprising a pair of A.C. back connectors on a back side of said module housing, said back connectors being electrically in parallel with said first and second A.C. power connectors, said back connectors on one of said ballast modules being configured to mate with said back connectors on another of said ballast modules with said ballast modules in back-to-back relationship.

3. The modular ballast system of claim 1 wherein said base is an elongated track and said module housing has mounting means adapted for releasably interlocking with said track at any of a plurality of mounting locations along said track.

4. The modular ballast system of claim 3 wherein said mounting means are adapted to make snap engagement with said track at regularly spaced intervals along said track.

5. The modular ballast system of claim 1, said electrically conductive means having connector elements at opposite ends thereof, said each of said connector elements being releasably operatively engageable with a corresponding one of said first and second A.C. power connectors thereby to complete a bridge type ballast circuit, and means for supplying A.C. power to one or both of said first and second A.C. power connectors.

6. A fluorescent lamp track lighting system comprising:

a track for mounting to a supporting surface; a first plurality of fluorescent lamp tubes along said track, each having a heater filament at opposite ends of the lamp tube;

first and second ballast modules on opposite ends of each of said lamp tubes, each of said ballast modules having a module housing, a pair of lamp connectors on one side of said module housing adapted to make electrical contact with opposite ends of a said heater filament, first and second A.C. power connectors on each of said ballast modules, an inductance between one of said pair of lamp connectors and one of said first and second A.C. power connectors, a capacitance between the other of said pair of lamp connectors and the other of said first and second A.C. power connectors, means for mounting said module housing to said track, and a pair of A.C. back connectors on a back side of said housing, said back connectors being electrically in parallel with said first and second A.C. power connectors;

adjacent ones of said ballast modules in back-to-back pairs between said lamp tubes being electrically connected by said back connectors for supplying A.C. power from one module to the other in said pairs;

jumper means for electrically connecting said first and second A.C. power connectors of said ballast modules at opposite ends of each of said tubes;

such that said jumper means and said back connectors together establish an A.C. power rail along said track with said ballast modules connected in parallel across said rail; and means for supplying A.C. electrical power to said rail.

7. The fluorescent lamp track lighting system system of claim 6 wherein said mounting means are adapted for releasably interlocking with said track at any of a plurality of mounting locations along said track.

8. The fluorescent lamp track lighting system of claim 7 wherein all of said first and second ballast modules are substantially identical to each other.

9. A modular ballast system comprising:

first and second module housings, each having contact means for receiving end pins of a fluorescent lamp, said first and second module housings being removably mounted on a common base;

capacitance and inductance elements in each of said first and second module housings; electrical conductor means operatively interconnecting said capacitance and inductance elements in each of said first and second module housings thereby to define a bridge type ballast circuit for powering a fluorescent lamp load connected between said contact means of said first and second module housings; and connectors on each of said first and second module housings for connecting said bridge type ballast circuit to a source of A.C. power, wherein said connectors are back connectors arranged and configured so as to provide for connection of A.C. power from one of said first and second module housings to a third module housing similar to said first and second module housings when said third module housing is assembled in back-to-back relationship to said one of said first and second module housings.

10. The modular ballast system of claim 9 wherein said electrical conductor means comprise a jumper cable releasably connected between said first and second module housings.

11. The modular ballast system of claim 9 wherein said capacitance and inductance elements in each of said first and second module housings include only one capacitor and one inductor.

12. The modular ballast system of claim 9 wherein each of said first and second module housings has a front side and a back side, said contact means are on said front side, and further comprising A.C. power connectors on each of said front side and said back side, said A.C. power connectors on said front side and said back side being connected to each other.

13. The modular ballast system of claim 9 wherein said common base is elongated for supporting multiples of said first and second module housings.

14. A ballast module comprising:

a module housing, A.C. power connectors and lamp connectors on said module housing, two arms of a four arm bridge type ballast circuit connected between said A.C. power connectors and said lamp connectors, such that a four arm bridge type ballast circuit is made by connecting said A.C. power connectors to the A.C. power connectors of another similar ballast module.

15. The ballast module of claim 14 wherein said two arms are comprised of an inductance and a capacitance respectively.

16. The ballast module of claim 15 wherein said module housing has a front side and a back side, said contact means are on said front side, and said A.C. power connectors are on each of said front side and said back side.

* * * * *